US009062277B1

(12) United States Patent
Wycoff et al.

(10) Patent No.: US 9,062,277 B1
(45) Date of Patent: Jun. 23, 2015

(54) COMPOSITION AND METHOD FOR TREATING SURFACES

(71) Applicant: Zap! Products, Inc., Longmont, CO (US)

(72) Inventors: Jeffrey Wycoff, Boulder, CO (US); Don E. Reynolds, Athens, TN (US)

(73) Assignee: ZAP! Holdings, LLC, Longmont, CO (US)

( * ) Notice: Subject to any disclaimer, the term of this patent is extended or adjusted under 35 U.S.C. 154(b) by 36 days.

(21) Appl. No.: 13/857,966

(22) Filed: Apr. 5, 2013

Related U.S. Application Data

(60) Provisional application No. 61/624,914, filed on Apr. 16, 2012, provisional application No. 61/712,938, filed on Oct. 12, 2012, provisional application No. 61/794,204, filed on Mar. 15, 2013.

(51) Int. Cl.

| | |
|---|---|
| ***C11D 1/94*** | (2006.01) |
| ***C11D 1/10*** | (2006.01) |
| ***C11D 3/20*** | (2006.01) |
| ***C11D 3/34*** | (2006.01) |
| ***C11D 3/36*** | (2006.01) |
| ***C11D 3/50*** | (2006.01) |

(52) U.S. Cl.
CPC ..... *C11D 1/10* (2013.01); *C11D 3/2068* (2013.01); *C11D 3/2086* (2013.01); *C11D 3/3409* (2013.01); *C11D 3/365* (2013.01); *C11D 3/50* (2013.01)

(58) Field of Classification Search
CPC ..... C11D 1/10; C11D 3/365; C11D 3/3409
USPC ..... 510/467, 477, 501
See application file for complete search history.

(56) References Cited

FOREIGN PATENT DOCUMENTS

WO WO 2005/070205 * 8/2005

OTHER PUBLICATIONS

U.S. Appl. No. 61/624,904, filed Apr. 16, 2012.
U.S. Appl. No. 61/712,938, filed Oct. 12, 2012.
U.S. Appl. No. 61/794,204, filed Mar. 15, 2013.

* cited by examiner

*Primary Examiner* — John Hardee
(74) *Attorney, Agent, or Firm* — CR Miles P.C.; Craig R. Miles

(57) ABSTRACT

Compositions to treat surfaces to affect materials deposited on such surfaces and methods of treating surfaces with such compositions to affect such deposition materials.

13 Claims, 1 Drawing Sheet

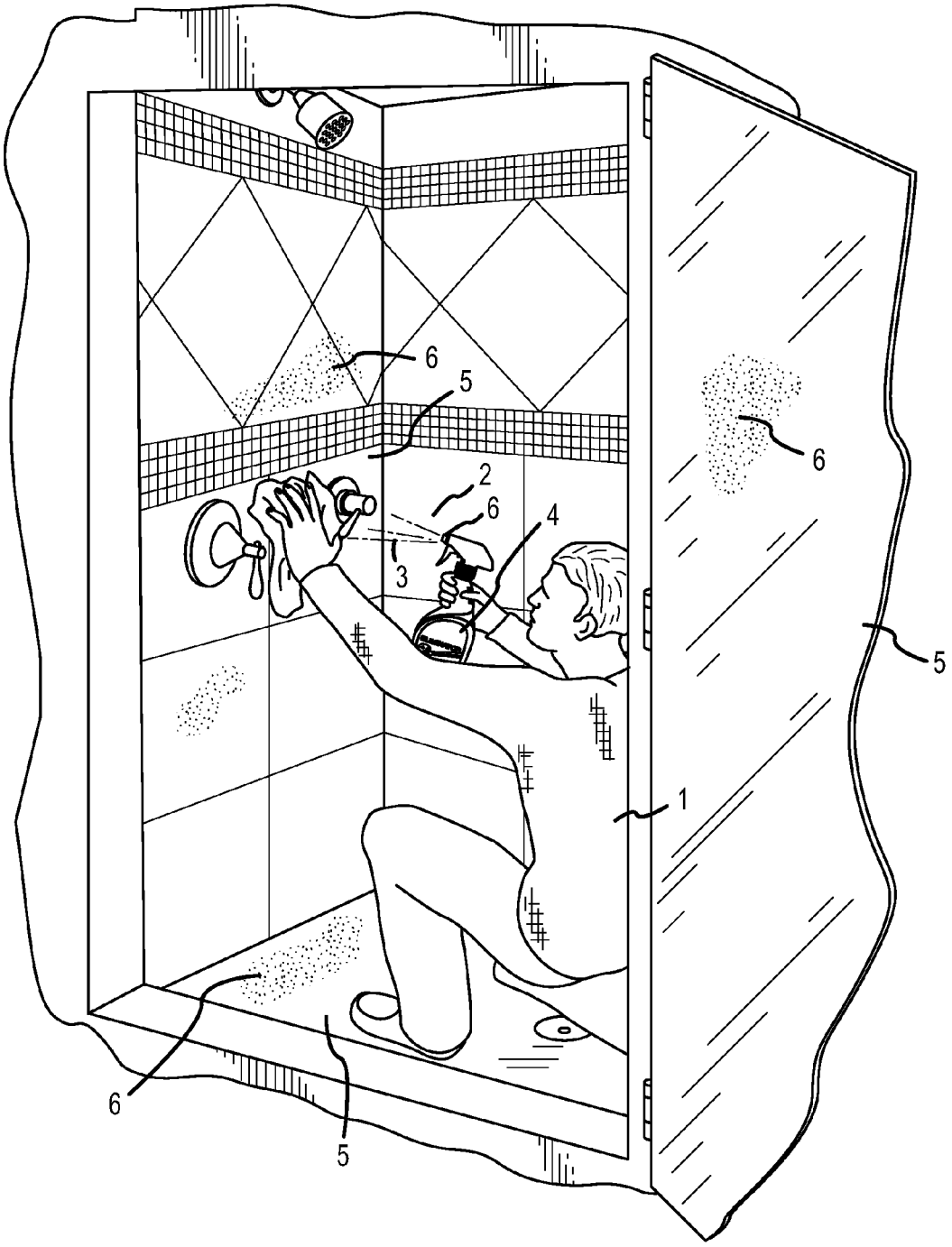
6
5
2
6
4
3
6
5
1
6
5

COMPOSITION AND METHOD FOR TREATING SURFACES

This United States Non-Provisional Patent Application claims the benefit of U.S. Provisional Patent Application No. 61/624,904, filed Apr. 16, 2012, U.S. Provisional Patent Application No. 61/712,938, filed Oct. 12, 2012, and U.S. Provisional Patent Application No. 61/794,204, filed Mar. 15, 2013, each hereby incorporated by reference herein.

I. BACKGROUND

Compositions to treat surfaces to affect surfaces and materials deposited on such surfaces and methods of treating surfaces with such compositions to affect such deposition materials.

A numerous and wide range of materials can be deposited on surfaces such as metals, constituents of hard water, lime scale, soap scum, mold, mildew, dirt, or the like. These deposition materials can be difficult to remove from surfaces such as ceramic or glazed tile surfaces, grout surfaces, porcelain surfaces, metal surfaces, fiberglass surfaces, glass surfaces, or the like.

A significant problem with conventional compositions utilized to treat surfaces, or clean or remove deposition materials from surfaces can be the inclusion of constituents which can alter characteristics of surfaces whether the characteristics of the surface intended to be treated or the characteristics of surfaces inadvertently treated. Certain conventional compositions can be particularly harmful to metal plated surfaces of facet and drain fixtures or paint surfaces.

Another significant problem with conventional compositions utilized to treat surfaces can be inclusion of phosphorus, generally in the form of phosphates. The strong cleaning performance, however, has increasingly been overshadowed by their harmful effects on rivers, lakes, streams, and other fresh waters. Levels of phosphates in these fresh water bodies can be much higher than normal as the result of contamination from municipal and domestic wastewater that contains phosphates. While phosphates are an important plant nutrient, higher than normal phosphate levels can destroy the health of the lake, stream or other fresh water body, as they allow algae in the water to grow faster than would naturally occur, turning clear lakes and rivers green and cloudy. Given these harmful effects, laws or regulations were enacted in many U.S. states, the European Union, Canada, and in Japan to limit or ban the use of phosphates in certain compositions.

The inventive surface treatment composition(s) substantially without phosphates as described herein act upon application to affect deposition materials on surfaces while avoiding or reducing alteration of characteristics of the treated surfaces.

II. SUMMARY OF THE INVENTION

Accordingly, a broad object of the invention can be to provide surface treatment compositions without substantial amounts of phosphates which can be transferred to surfaces to affect deposition materials such as those above-described without or with a reduced alteration of characteristics of the treated surfaces.

Naturally, further objects of the invention are disclosed throughout other areas of the specification, drawings, photographs, and claims.

III. A BRIEF DESCRIPTION OF THE DRAWINGS

FIG. 1 shows an exemplary method of using the inventive composition to treat surfaces.

IV. DETAILED DESCRIPTION OF THE PREFERRED EMBODIMENTS

Now referring to FIG. 1, a non-limiting exemplary method of using embodiments of the inventive surface treatment composition(s) to treat surfaces or affect deposition materials on surfaces is shown. A person (1) can transfer (2) an amount of the inventive surface treatment composition (3) from a container (4) onto a surface (5) to be treated. As shown in the illustrative example of FIG. 1, an amount of the surface treatment composition (3) can be transferred (2) by spraying a light coat of surface treatment composition from a spray element (6) coupled to the container (4) to the (5) surface being treated. The amount of surface treatment composition (3) transferred to the surface (5) can be allowed to reside in contact with the surface (5) or deposition materials (6) without further distribution over the surface (5) for a duration of time (the residence time being typically between about one minute and two minutes). Whether or not a residence time has elapsed, the amount of surface treatment composition (3) can be distributed over the surface (5) being treated using a towel, cloth, sponge, or the like. Forcibly urging the surface treatment composition (3) into the deposition material (6) on the treated surface (5) or scrubbing the surface (5) treated with the surface treatment composition (3) with a towel, cloth, sponge, brush, or the like can facilitate the affect of the surface treatment composition (3) on the deposition material (6). The surface (5) treated can then be rinsed with an amount of water to transfer the amount of the surface treatment composition (3) along with an amount of the deposition material(s) (6) from the surface (5).

The term "transferred or transfer" as used herein broadly encompasses any manner of contacting a surface with an amount of inventive composition and as illustrative examples, includes applying, brushing, spraying, pouring, wiping, or spreading an amount of the inventive composition on a surface or applying an amount of the inventive composition onto a material such as a sponge or a pad and contacting the material having such amount of the inventive composition applied to the surface treated.

The term "surface or surfaces" as used herein refers to the external surface of any material and as illustrative examples includes: copper, iron, brass, stainless steel, ceramics, porcelain, fiberglass, glass, grout, or similar metal or crystalline surfaces.

The term "affect" as used herein refers to any manner in which the inventive composition acts upon deposition materials and as illustrative examples includes: reacting with deposition materials to oxidize, reduce, or otherwise alter certain component elements, dissolving, solvating, diluting, loosening, allowing transfer or removal of deposition material or constituents of the deposition material from the surface whether in whole or in part.

The term "deposition materials" as used herein broadly encompasses any material deposited on a surface and as illustrative examples, includes: stains, rust stains, magnesium and calcium carbonates, mildew, mold, dirt, soap scum, or the like.

The term "alteration of characteristics of the treated surfaces" as used herein broadly encompasses any alteration to the treated surface sensorially perceivable not owing to the removal of deposition materials from the surface treated, and without limitation to the breadth of the foregoing, includes: altering the color; altering the surface texture; altering the sheen, luster, shine, or gloss; removal of a portion of the metal plate from a base metal; etching, pitting, abrading of the surface; or the like.

The term "inventive composition" as used herein broadly encompasses any formulation which contains at least two or more of the raw materials set forth within this description irrespective of the proportions in which the two or more raw materials described herein are combined or may be combined with additional raw materials whether or not described herein, and irrespective as to whether the proportions are described as percent by volume or percent by weight or otherwise, and irrespective of the manner in which the two or more of the raw materials are combined or combined with additional materials whether or not described, and specifically encompasses the combinations of raw materials included in any exemplary formulations described herein without regard to proportion, and more specifically encompasses the combinations of raw materials described herein in the proportions disclosed. In those instances in which a trademark is utilized to identify a raw material, the chemical constituents included in the raw material identified by the trademark are further described by chemical name(s) and weight percent(ages). Chemical names of raw materials and the corresponding weight percentages rather than the trademark are utilized in the claims as required. Understandably, the weight percent allocated to an admixture of chemical constituents encompassed by a trademark will be greater than the weight percent allocated to each of the constituent chemicals as set forth in the claims. Additionally, in those instances in which an admixture of raw materials identified by a trademark includes water (as shown by the examples of Tables 1 through 10), the weight percent allocated to the admixture of materials encompassed by the trademark will include the weight percent of the water.

Now referring primarily to Table 1, an exemplary embodiment of the inventive surface treatment composition (3) can include formulations which include the raw materials identified in column one (labeled "raw materials") admixed in the exemplary weight percentages indicted in column two (labeled "wt %"). Numerous embodiments of the inventive surface treatment composition can be prepared by altering the weight percentage of the raw materials within the range weight percentage ("Range Wt %") shown in column three with water making up the balance.

TABLE 1

| Raw Materials | Wt % | Range Wt % |
|---|---|---|
| Water | 52.870 | Balance |
| Mayoquest 2100 | 0.500 | 0.1 to 1.7 |
| Citric Acid Anydrous | 4.000 | 1.0 to 10.0 |
| Purac 88 HS | 8.000 | 1.0 to 40.0 |
| Lutropur MSA | 10.000 | 2.5 to 50.0 |
| Glycolic Acid 70% | 20.000 | 1.0 to 45.0 |
| Dowanol PM | 0.950 | 0.1 to 1.0 |
| Miranol FBS | 0.500 | 0.1 to 10.0 |
| Tomadol 91-6 | 3.000 | 0.1 to 10.0 |
| Totals | 100.000 | |
| S.G. | 1.1159 | |
| pH < | 1.000 | |
| Density | 9.295 | |
| Cloud Point > | 60.000 | |
| Phosphorous Content % | 0.057 | |

Now referring primarily to Table 2, the various embodiments of the inventive surface treatment composition (3) can further include various combinations of dyes and fragrances. While Table 2 only provides an exemplary combination of fragrances (lemon fragrance and wintergreen fragrance) any of a numerous and wide variety of fragrances or dyes in various permutations and combination can be used as persons of ordinary skill in the art would understand.

TABLE 2

| Raw Materials | Wt % | Range Wt % |
|---|---|---|
| Lemon Fragrance | 0.100 | 0.25 to 1.0 |
| Methyl Salicylate | 0.100 | 0.025 to 1.0 |

Now referring primarily to Table 3, an exemplary embodiment of the inventive surface treatment composition can include a formulation which includes the raw materials of indicated in column 1 ("Raw Materials") admixed in the exemplary weight percentages indicted in column 2 ("Wt %").

TABLE 3

| Raw Materials | Wt % |
|---|---|
| DI Water - Room Temp | 52.850 |
| Mayoquest 2100 | 0.500 |
| Citric Acid Anydrous | 4.000 |
| Purac 88 HS | 8.000 |
| Lutropur MSA | 10.000 |
| Glycolic Acid 70% | 20.000 |
| Dowanol PM | 0.950 |
| Miranol FBS | 0.500 |
| Tomadol 91-6 | 3.000 |
| Lemon Fragrance | 0.100 |
| Methyl Salicylate | 0.100 |
| Totals | 100.000 |
| S.G. | 1.1159 |
| pH < | 1.000 |
| Density | 9.295 |
| Cloud Point > | 60.000 |
| Phosphorous Content % | 0.057 |

The formulation set out by Table 3 provides a particular embodiment of the inventive surface treatment composition (3); however, the formulations of Tables 1 through 3 are intended to provide a person of ordinary skill in the art a sufficient description to make a wide range of embodiments of the inventive surface treatment composition (3) by adjusting the proportions of the various raw materials listed.

For example, the amount of MAYOQUEST 2100 (2-phosphonobutane-1,2,4 tricarboxylic acid 50% (CAS No: 37971-36-1), trade secret ingredients, water (CAS No: 7732-18-5) to 100%) available from Cathay Industries Australasia Pty Lt. included in the particular embodiment of the inventive surface treatment composition shown in Table 3 can be about 0.5% or as to other embodiments in the range of about 0.1% to about 1.7% by weight (as shown in Table 1), but could also be of greater or lesser weight percent depending on the particular deposition material (6) to be treated and the particular surface (5) to be treated and can as to certain embodiments of the surface treatment composition(s)(3) be by weight percent a percentage selected from the group consisting of: between about 0.1% to about 0.5%, between about 0.5% to about 1.0%, between about 1.0% and about 1.7% or with respect to a particular preferred embodiments of the surface treatment composition (3) about 0.5% (plus or minus 0.25%), or 0.5% as shown in Table 3.

Similarly, the amount citric acid (2-Hydroxy-1,2,3-propanetricarboxylic acid, CAS No: 77-92-9) available from Jungbunzlauer.com, Inc. included in the particular embodiment of the inventive surface treatment composition shown in Table 3 can be about 4.0% or as to other embodiments in the range of about 3.0% to about 5.0% by weight (as shown in Table 1), but could also be of greater or lesser weight percent depending on the particular deposition material (6) to be treated and the particular surface (5) to be treated and could as to certain embodiments of the surface treatment composition(s)(3) be by weight percent a percentage selected from within the range of about 1.0% to about 10. % or from the group consisting of: between about 3.0% to about 4.0%, between about 3.5% to about 4.0%, and between about 4.0% to about 5.0%, or with respect to a particular preferred embodiments of the surface treatment composition (3) about 4.0% (plus or minus 0.50%), or 4.0% as shown in Table 3.

Similarly, the amount of LUTROPUR® MSA (methanesulphonic acid; $CH_3SO_3H$ >99.5%, CAS No.: 75-75-2; 60%-100% safety data sheet 2012, 69.5%-70.0% safety data sheet 2011) available from BASF Aktiengesellschaft included in the particular embodiment of the inventive surface treatment composition of Table 3 can be 10.0% by weight; however, other embodiments can be produced by adjusting the amount of Lutopur MSA within the range of 2.5% to 50% by weight (as shown in Table 1), or even a greater or lesser weight percent depending on the particular deposition material (6) to be treated and the particular surface (5) to be treated and could as to certain embodiments of the surface treatment composition(s)(3) be by weight percent a percentage selected from the group consisting of: between about 2.5% to about 5.0%; between about 2.5% to about 10.0%; between about 5.0% to about 10.0%; between about 10% to about 15.0%; between about 15.0% to about 20.0%; between about 20.0% to about 25.0% between about 25.0% to about 30.0%; between about 30.0% to about 35.0%; between about 35.0% to about 40%; between about 40.0% to about 45.0%; between about 45.0% to about 50.0%, or with respect to a particular embodiments of the surface treatment composition (3) about 10% (plus or minus 0.5%), or about 10% as shown in Table 3.

Similarly, the amount PURAC® HS 88 (L(+)-lactic acid 88.0-89.0% in water, CAS No: 79-33-4) available from Purac included in the particular embodiment of the inventive surface treatment composition shown in Table 3 can be about 8.0% or as to other embodiments in the range of about 1.0% to about 40.0% by weight (as shown in Table 1), but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 1.0% to about 40.0% with embodiments incrementally in the range at about 0.5% intervals, or with respect to a particular preferred embodiments of the surface treatment composition (3) about 8.0% (plus or minus 0.50%), or 8.0% as shown in Table 3.

Similarly, the amount glycolic acid 70% (glycolic acid 70% by weight, CAS No: 79-14-1, and water 30% by weight, CAS No: 7732-1-5) available from DuPont Company included in the particular embodiment of the inventive surface treatment composition shown in Table 3 can be about 20.0% or as to other embodiments in the range of about 1.0% to about 45.0% by weight (as shown in Table 1), but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 18.0% to about 19.0%, between about 18.5% to about 19.5%, between about 19.0% to about 20.0%, between about 19.5% to about 20.5%, between about 20.0% to about 21.0%, between about 20.5% to about 21.5%, and between about 21.0% to about 22.0% or with respect to a particular preferred embodiments of the surface treatment composition (3) about 20.0% (plus or minus 0.50%), or 20.0% as shown in Table 3.

Similarly, the amount DOWANOL® (propylene glycol methyl ether, $CH_3OCH_2CHOHCH_3$, CAS No: 107-98-2) available from DOW® included in the particular embodiment of the inventive surface treatment composition shown in Table 3 can be about 0.95% or as to other embodiments in the range of about 0.1% to about 1.0% by weight (as shown in Table 1), but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.85% to about 0.95%, between about 0.90% to about 1.0%, and between about 0.95% to about 1.05%, or with respect to a particular preferred embodiments of the surface treatment composition (3) about 0.95% (plus or minus 0.50%), or 0.95% as shown in Table 3.

Similarly, the amount MIRANOL® FBS (disodium cocoamphodipropionate >38%, CAS No: 68604-71-7, methanol <5%, CAS No: 67-56-1, water <57%) available from Rhodia Group included in the particular embodiment of the inventive surface treatment composition shown in Table 3 can be about 0.5% or as to other embodiments in the range of about 0.1% to about 10.0% by weight (as shown in Table 1), but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.25 to about 0.75%, and between about 0.5 to about 1.0%, or with respect to a particular preferred embodiments of the surface treatment composition (3) about 0.5% (plus or minus 0.25%), or 0.5% as shown in Table 1.

Similarly, the amount Tomadol 91-6 (ethoxylated alcohol, CAS No: 68439-46-3), available from Air Products and Chemicals, Inc., 7201 Hamilton Boulevard, Allentown, Pa. included in the particular embodiment of the inventive surface treatment composition shown in Table 3 can be about 3.0% or as to other embodiments in the range of about 0.1% to about 10.0% by weight (as shown in Table 1), but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 2.0% to about 3.0% and between about 2.5% to about 3.5% or with respect to a particular preferred embodiments of the surface treatment composition (3) about 3.0% (plus or minus 0.0.5%), or 3.0% as shown in Table 3.

Similarly, the amount methyl salicylate (CAS No: 119-36-8) available from Sciencelab.com, Inc. included in the particular embodiment of the inventive surface treatment composition shown in Table 3 can be about 0.10% or as to other embodiments in the range of about 0.025% to about 1.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.05% to about 0.10%, and between about 0.075% to about 0.15%, or with respect to a particular preferred embodiments of the surface treatment composition (3) about 0.10% (plus or minus 0.050%), or 0.10% as shown in Table 3.

Again fragrance(s) and dyes included in particular embodiments of the inventive surface treatment composition can be in the range of between about 0.025% and about 1.0% by weight, but could also be of greater or lesser weight percent depending upon the particular fragrance(s) selected and depending upon the level of sensorial perceivable scent or color desired for a particular embodiment of the inventive surface treatment composition (3). A numerous and wide variety of fragrances and dyes are available suitable for use in embodiments of the surface treatment composition (3) and it is not intended that the inventive composition(s) be limited to inclusion of any single particular fragrance or dye or combination of fragrances or dyes in the composition. The fragrance portion, such as lemon fragrance available for example from Aromatic Fragrances and Flavors International, Marietta, Ga., or other fragrance(s) as desired can then be added to the prior combination and mixed until the solution is homogeneous and clear.

Water can comprise the balance of the surface treatment composition (3) by weight percent, as shown in Tables 1 and 3. However, it not intended that embodiments of the inventive surface treatment compositions (3) be limited solely to or consisting of the raw materials listed and embodiments of the inventive surface treatment compositions (3), but rather the inventive surface treatment composition(s)(3) can further include or comprise raw materials not listed. Understandably, as additional raw materials are added the balance weight percent water will correspondingly be altered, or the weight percent of each raw material may be altered to accommodate the additional raw materials. The water can be filtered, deionized, distilled, or water otherwise filtered or purified.

Similarly, a dye can be added to provide the desired appearance to the composition.

TABLE 4

| Raw Materials | Wt % |
|---|---|
| DI Water - Room Temp | 91.50 |
| Xiameter OFS-0777 | 7.50 |
| Dow Corning Z-6137 | 1.00 |
| Busan 1078 | 0.10 |
| Totals | 100.00 |
| S.G. | 1.0272 |

The formulation set out by Table 4 provides a particular embodiment of the inventive surface treatment composition (3). The formulation of Table 4 is intended to provide a person of ordinary skill in the art sufficient information to make a wide range of embodiments of the inventive surface treatment composition (3) by adjusting the proportions of the various raw materials listed.

For example, the amount of Xiameter OFS-0777 (silicon resin solutions including potassium methyl siliconate 30%-60% (w/w); CAS No.: 31795-24-1) available from Dow Corning included in the particular embodiment of the inventive surface treatment composition of Table 4 can be 7.50% by weight; however, other embodiments can be produced by adjusting the amount of Xiameter OFS-0777 within the range of 5.0% to 25.0% by weight, or even a greater or lesser weight percent depending on the particular surface (5) to be treated and could as to certain embodiments of the surface treatment composition(s)(3) be by weight percent a percentage selected from the group consisting of: between about 5.0% to about 10.0%; between about 7.5% to about 12.5%; between about 10.0% to about 15.0%; between about 12.5% to about 17.5%; between about 15.0% to about 20.0%; between about 17.5% to about 22.5%; and between about 22.5% to about 25.0%; or with respect to a particular embodiments of the surface treatment composition (3) about 8% (plus or minus 0.5%), or about 7.50% as shown in Table 4.

Similarly, the amount of Dow Corning Z-6137 (organic silane solution including (3-((2-Aminoethyl)amino)propyl) silanetriol homopolymer 15%-35% (w/w); CAS No.: 68400-09-9) available from Dow Corning included in the particular embodiment of the inventive surface treatment composition of Table 4 can be 1.00% by weight; however, other embodiments can be produced by adjusting the amount of Z-6137 within the range of 1.0% to 5.0% by weight, or even a greater or lesser weight percent depending on the particular surface (5) to be treated and could as to certain embodiments of the surface treatment composition(s)(3) be by weight percent a percentage selected from the group consisting of: between about 1.0% to about 3.0%; between about 2.0% to about 4.0%; between about 3.0% to about 5.0%; or with respect to a particular embodiments of the surface treatment composition (3) about 1.0% (plus or minus 0.5%), or about 1.00% as shown in Table 4.

Similarly, the amount of Busan 1078 available from Buckman Laboratories, 1256 North McLean Blvd., Memphis, Tenn. 38108 comprises the following ingredients by weight percent:

CAS No. None reported. 5-Chloro-2-Methyl-4-isothiazolin-3-one 1.15%;

CAS No. None reported. 2-Methyl-4-isothiazolin-3-one 0.35%;

CAS No. 7732-18-5 Water 98.5%;

included in the particular embodiment of the inventive surface treatment composition of Table 4 can be 0.10% by weight; however, other embodiments can be produced by adjusting the amount of Z-6137 within the range of 0.05% to 0.25% by weight, or even a greater or lesser weight percent depending on the particular surface (5) to be treated and could as to certain embodiments of the surface treatment composition(s)(3) be by weight percent a percentage selected from the group consisting of: between about 0.05% to about 0.15%; between about 0.10% to about 0.20%; between about 0.15% to about 0.25%; or with respect to a particular embodiments of the surface treatment composition (3) about 0.1% (plus or minus 0.05%), or about 0.1% as shown in Table 4.

Water can comprise the balance of the surface treatment composition (3) by weight percent, as shown in Table 4. However, it not intended that embodiments of the inventive surface treatment compositions (3) be limited solely to or consisting of the raw materials listed and embodiments of the inventive surface treatment compositions (3), but rather the inventive surface treatment composition(s)(3) can further include or comprise raw materials not listed. Understandably, as additional raw materials are added the balance weight percent water will correspondingly be altered, or the weight percent of each raw material may be altered to accommodate the additional raw materials. The water can be filtered, deionized, distilled, or water otherwise filtered or purified.

TABLE 5

| Raw Materials | Wt % |
|---|---|
| DI Water - Room Temp | 84.00 |
| Xiameter OFS-0777 | 15.00 |
| Dow Corning Z-6137 | 1.00 |
| Busan 1078 | 0.10 |
| Totals | 100.00 |
| S.G. | 1.0272 |

The formulation set out by Table 5 provides a particular embodiment of the inventive surface treatment composition (3). The formulation of Table 5 is intended to provide a person of ordinary skill in the art sufficient information to make a wide range of embodiments of the inventive surface treatment composition (3) by adjusting the proportions of the various raw materials listed.

For example, the amount of Xiameter OFS-0777 (silicon resin solutions including potassium methyl siliconate 30%-60% (w/w); CAS No.: 31795-24-1) available from Dow Corning included in the particular embodiment of the inventive surface treatment composition of Table 5 can be 15.00% by weight; however, other embodiments can be produced by adjusting the amount of Xiameter OFS-0777 within the range of 10.0% to 20.0% by weight, or even a greater or lesser weight percent depending on the particular surface (5) to be treated and could as to certain embodiments of the surface treatment composition(s)(3) be by weight percent a percentage selected from the group consisting of: between about 10.0% to about 15.0%; between about 12.5% to about 17.5%; between about 15.0% to about 20%; between about 17.5% to about 20.0%; or with respect to a particular embodiments of the surface treatment composition (3) about 15% (plus or minus 5.0%), or about 15.00% as shown in Table 5.

Similarly, the amount of Dow Corning Z-6137 (organic silane solution including (3-((2-Aminoethyl)amino)propyl) silanetriol homopolymer 15%-35% (w/w); CAS No.: 68400-09-9) available from Dow Corning included in the particular embodiment of the inventive surface treatment composition of Table 4 can be 1.00% by weight; however, other embodiments can be produced by adjusting the amount of Z-6137 within the range of 0.5% to 1.50% by weight, or even a greater or lesser weight percent depending on the particular surface (5) to be treated and could as to certain embodiments of the surface treatment composition(s)(3) be by weight percent a percentage selected from the group consisting of: between about 0.5% to about 1.0%; between about 0.75% to about 1.25%; between about 1.0% to about 1.5%; or with respect to a particular embodiments of the surface treatment composition (3) about 1.0% (plus or minus 0.5%), or about 1.00% as shown in Table 5.

Similarly, the amount of Busan 1078 available from Buckman Laboratories, 1256 North McLean Blvd., Memphis, Tenn. 38108 comprises the following ingredients by weight percent:

CAS No. None reported. 5-Chloro-2-Methyl-4-isothiazolin-3-one 1.15%;

CAS No. None reported. 2-Methyl-4-isothiazolin-3-one 0.35%;

CAS No. 7732-18-5 Water 98.5%;

included in the particular embodiment of the inventive surface treatment composition of Table 4 can be 0.10% by weight; however, other embodiments can be produced by adjusting the amount of Z-6137 within the range of 0.05% to 0.15% by weight, or even a greater or lesser weight percent depending on the particular surface (5) to be treated and could as to certain embodiments of the surface treatment composition(s)(3) be by weight percent a percentage selected from the group consisting of: between about 0.05% to about 0.10%; between about 0.075% to about 0.125%; between about 0.10% to about 0.15%; or with respect to a particular embodiments of the surface treatment composition (3) about 0.1% (plus or minus 0.05%), or about 0.1% as shown in Table 5.

Water can comprise the balance of the surface treatment composition (3) by weight percent, as shown in Table 5. However, it not intended that embodiments of the inventive surface treatment compositions (3) be limited solely to or consisting of the raw materials listed and embodiments of the inventive surface treatment compositions (3), but rather the inventive surface treatment composition(s)(3) can further include or comprise raw materials not listed. Understandably, as additional raw materials are added the balance weight percent water will correspondingly be altered, or the weight percent of each raw material may be altered to accommodate the additional raw materials. The water can be filtered, deionized, distilled, or water otherwise filtered or purified.

TABLE 6

| Raw Materials | Wt % |
|---|---|
| DI Water - Room Temp | 76.415 |
| Mayoquest 2100 | 0.500 |
| Citric Acid Anydrous | 4.000 |
| Purac 88 HS | 4.000 |
| Gluconic Acid 50% | 10.000 |
| Akypo LF-2 | 4.000 |
| Ammonyx LO | 0.100 |
| Dowanol DPNP | 0.950 |
| Crystal Waters | 0.035 |
| Fragrance | |
| Totals | 100.000 |
| S.G. | 1.056 |
| pH < | <1.000 |
| | 8.799 |
| Density | lbs/gal |
| Cloud Point > | 65.000 |

The formulation set out by Table 6 provides a particular embodiment of the inventive surface treatment composition (3). The formulation of Table 6 is intended to provide a person of ordinary skill in the art sufficient information to make a wide range of embodiments of the inventive surface treatment composition (3) by adjusting the proportions of the various raw materials listed.

Similarly, the amount MAYOQUEST 2100 (2-phosphonobutane-1,2,4 tricarboxylic acid 50% (CAS No: 37971-36-1), trade secret ingredients, water (CAS No: 7732-18-5) to 100%) available from Cathay Industries Australasia Pty Lt. included in the particular embodiment of the inventive surface treatment composition shown in Table 6 can be about 0.5% or as to other embodiments in the range of about 0.1% to about 1.7% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.1% to about 0.5%, between about 0.5% to about 1.0%, between about 1.0% and about 1.7% or with respect to a particular preferred embodiments of the surface treatment composition (3) about 0.5% (plus or minus 0.25%), or 0.5% as shown in Table 6.

Similarly, the amount citric acid (2-Hydroxy-1,2,3-propanetricarboxylic acid, CAS No: 77-92-9) available from jungbunzlauer.com included in the particular embodiment of the inventive surface treatment composition shown in Table 6 can be about 4.0% or as to other embodiments in the range of about 3.0% to about 5.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from within the range of about 1.0% to about 10. % or from the group consisting of: between about 3.0% to about 4.0%, between about 3.5% to about 4.0%, and between about 4.0% to about 5.0%, or with respect to a particular preferred embodiments of the surface treatment composition (3) about 4.0% (plus or minus 0.50%), or 4.0% as shown in Table 6.

Similarly, the amount PURAC® HS 88 (L(+)-lactic acid 88.0-89.0% in water, CAS No: 79-33-4) available from Purac included in the particular embodiment of the inventive surface treatment composition shown in Table 6 can be about 4.0% or as to other embodiments in the range of about 3.0% to about 5.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from within the range of about 1.0% to about 10. % or from the group consisting of: between about 3.0% to about 4.0%, between about 3.5% to about 4.0%, and between about 4.0% to about 5.0%, or with respect to a particular preferred embodiments of the surface treatment composition (3) about 4.0% (plus or minus 0.50%), or 4.0% as shown in Table 6.

Similarly, the amount gluconic acid, 50% in water (gluconic acid CAS No: 526-95-4) available from jungbunzlauer.com included in the particular embodiment of the inventive surface treatment composition shown in Table 6 can be about 10.0% or as to other embodiments in the range of about 5.0% to about 15.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 5.0% to about 10.0%, between about 7.5% to about 12.5%, between about 10.0% to about 15.0%, between about 12.5% to about 15.0%, or with respect to a particular preferred embodiments of the surface treatment composition (3) about 10.0% (plus or minus 5.00%), or 10.0% as shown in Table 6.

Similarly, the amount of Akypo LF-2 available from Kao Chemicals GMbH, D-46446 Emmerich (capryleth-9 carboxylic acid 87.5% (CAS No.: 53563-70-5), sodium chloride 1.2%; and water 8.0%-11.0%) included in the particular embodiment of the inventive surface treatment composition shown in Table 6 can be about 4.0% or as to other embodiments in the range of about 3.0% to about 5.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from within the range of about 1.0% to about 10. % or from the group consisting of: between about 3.0% to about 4.0%, between about 3.5% to about 4.0%, and between about 4.0% to about 5.0%, or with respect to a particular preferred embodiments of the surface treatment composition (3) about 4.0% (plus or minus 0.50%), or 4.0% as shown in Table 6.

Similarly, the amount of Ammonyx LO available from Stepan Company 22 West Frontage Road, Northfield, Ill. 60093 comprises Water 68-71% CAS No. 7732-18-5 and Lauramine Oxide 29-31% CAS No. 1643-20-5 can as to the particular embodiment of the inventive surface treatment composition shown in Table 6 can be about 0.1% or as to other embodiments in the range of about 0.05% to about 0.15% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.05% to about 0.1%, between about 0.075% to about 0.125%, between about 0.1% to about 0.15%, between about 0.125% to about 0.15%, or with respect to a particular preferred embodiments of the surface treatment composition (3) about 0.10% (plus or minus 0.05%), or 0.10% as shown in Table 6.

Similarly, the amount DOWANOL® DPNB (Dipropylene glycol n-butylether, CAS No: 29911-28-2) available from DOW® included in the particular embodiment of the inventive surface treatment composition shown in Table 6 can be about 0.95% or as to other embodiments in the range of about 0.1% to about 1.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.85% to about 0.95%, between about 0.90% to about 1.0%, and between about 0.95% to about 1.05%, or with respect to a particular preferred embodiments of the surface treatment composition (3) about 0.95% (plus or minus 0.50%), or 0.95% as shown in Table 6.

Again fragrance(s) and dyes such as Crystal Waters Fragrance can be included in particular embodiments of the inventive surface treatment composition can be in the range of between about 0.025% and about 1.0% by weight, but could also be of greater or lesser weight percent depending upon the particular fragrance(s) selected and depending upon the level of sensorial perceivable scent or color desired for a particular embodiment of the inventive surface treatment composition (3). A numerous and wide variety of fragrances and dyes are available suitable for use in embodiments of the surface treatment composition (3) and it is not intended that the inventive composition(s) be limited to inclusion of any single particular fragrance or dye or combination of fragrances or dyes in the composition. The fragrance portion, such as lemon fragrance available for example from Aromatic Fragrances and Flavors International, Marietta, Ga., or other fragrance(s) as desired can then be added to the prior combination and mixed until the solution is homogeneous and clear.

Water can comprise the balance of the surface treatment composition (3) by weight percent, as shown in Table 6. However, it not intended that embodiments of the inventive surface treatment compositions (3) be limited solely to or consisting of the raw materials listed and embodiments of the inventive surface treatment compositions (3), but rather the inventive surface treatment composition(s)(3) can further include or comprise raw materials not listed. Understandably, as additional raw materials are added the balance weight percent water will correspondingly be altered, or the weight percent of each raw material may be altered to accommodate the additional raw materials. The water can be filtered, deionized, distilled, or water otherwise filtered or purified.

TABLE 7

| Raw Material | Wt Percent |
|---|---|
| Calumet Calpar 100 White Oil, Paraffin Based, Viscosity SUS 100 | 55.1089 |
| Petro Canada Purity L-35 or Paraflex HT-4 | 14.3300 |
| Petro-Canada Paraflex HT-4 | 14.3300 |
| Exxon Isopar M | 14.3300 |
| Macol 5100 | 0.1000 |
| 5 Fold Orange Oil | 1.8000 |
| Solvent Yellow | 0.0011 |
| Solvent Red | 0.00004 |
| Total | 100.0000 |
| SG | 0.8404 |
| Density | 7.0005 Lbs/Gal |

The formulation set out by Table 7 provides a particular embodiment of the inventive surface treatment composition (3). The formulation of Table 7 is intended to provide a person of ordinary skill in the art sufficient information to make a wide range of embodiments of the inventive surface treatment composition (3) by adjusting the proportions of the various raw materials listed.

For example, the amount of Calpar 100 (distillates of petroleum CAS No.: 64742-54-7 40-60% wt/wt and paraffin oils, catalytic dewaxed light CAS No.: 64742-71-8) available from Calumet Specialty Products, L.P., 270 Waterfront Pkwy. E. Dr., Suite 200, Indianapolis, Ind. included in the particular embodiment of the inventive surface treatment composition of Table 7 can be 55.1% by weight; however, other embodiments can be produced by adjusting the amount of Calpar 100 within the range of about 50% to 60% by weight, or even a greater or lesser weight percent depending on the particular deposition material (6) to be treated and the particular surface (5) to be treated and could as to certain embodiments of the surface treatment composition(s)(3) be by weight percent a percentage selected from the group consisting of: between about 50% to about 53%; between about 52% to about 54%; between about 53% to about 55%; between about 54% to about 56%; between about 55% to about 57%; between about 56% to about 58%; between about 57% to about 59%; between about 58% to about 60%, or with respect to a particular embodiments of the surface treatment composition (3) about 55% (plus or minus 5.0%), or about 55.10% as shown in Table 3.

Similarly, the amount of Petro-Canada L-35 (mixture of severely hydrotreated and hydrocracked base oil. The base oil may be a mixture of the following CAS#s: 8042-47-5, 64742-46-7, 64742-47-8, 64742-53-6, 64742-54-7, 64742-55-8, 72623-84-8, 72623-85-9, 72623-86-0, 72623-87-1, 178603-64-0, 178603-65-1, 178603-66-2, 445411-73-4) or Petro-Canada Paraflex HT-4 (mixture of severely hydrotreated and hydrocracked base oil. The base oil may be a mixture of the following CAS#s: 8042-47-5, 64742-46-7, 64742-47-8, 64742-52-5, 64742-54-7, 72623-84-8, 72623-85-9, 72623-86-0, 72623-87-1, 178603-64-0, 178603-65-1, 178603-66-2, 445411-73-4) available from Petro-Canada America, 980 North Michigan Avenue, Chicago, Ill. included in the particular embodiment of the inventive surface treatment composition shown in Table 7 can be about 14.3% or as to other embodiments in the range of about 10% to about 20% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 10% to about 13%, between about 12% to about 14%, between about 13% and about 15%, between about 14% and about 16%, between about 15% and about 17%, between about 16% and about 18%, between about 17% and about 19%, between about 18% and about 20%, or with respect to a particular preferred embodiments of the surface treatment composition (3) about 14.3% (plus or minus 5%), or 14.3300% as shown in Table 7.

Similarly Petro-Canada Paraflex HT-4 (mixture of severely hydrotreated and hydrocracked base oil. The base oil may be a mixture of the following CAS#s: 8042-47-5, 64742-46-7, 64742-47-8, 64742-52-5, 64742-54-7, 72623-84-8, 72623-85-9, 72623-86-0, 72623-87-1, 178603-64-0, 178603-65-1, 178603-66-2, 445411-73-4) available from Petro-Canada America, 980 North Michigan Avenue, Chicago, Ill. included in the particular embodiment of the inventive surface treatment composition shown in Table 7 can be about 14.3% or as to other embodiments in the range of about 10% to about 20% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 10% to about 13%, between about 12% to about 14%, between about 13% and about 15%, between about 14% and about 16%, between about 15% and about 17%, between about 16% and about 18%, between about 17% and about 19%, between about 18% and about 20%, or with respect to a particular preferred embodiments of the surface treatment composition (3) about 14.3% (plus or minus 5%), or 14.3300% as shown in Table 7.

Similarly, the amount Exxon Isopar M (2-Hydroxy-1,2,3-propanetricarboxylic acid, CAS No: 77-92-9) available from ExxonMobil Chemical Company, 13501 Katy Freeway, Houston, Tex. included in the particular embodiment of the inventive surface treatment composition shown in Table 7 can be about 14.3% or as to other embodiments in the range of about 10% to about 20% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 10% to about 13%, between about 12% to about 14%, between about 13% and about 15%, between about 14% and about 16%, between about 15% and about 17%, between about 16% and about 18%, between about 17% and about 19%, between about 18% and about 20%, or with respect to a particular preferred embodiments of the surface treatment composition (3) about 14.3% (plus or minus 5%), or 14.3300% as shown in Table 7.

Similarly, the amount Macol 5100 (Oxirane, methyl-, polymer with oxirane, monobutyl ether, CAS No. 9038-95-3) available from PVS Chemicals, Inc., 10900 Harper Avenue, Detroit, Mich. 48213 included in the particular embodiment of the inventive surface treatment composition shown in Table 7 can be about 0.1% or as to other embodiments in the range of about 0.05% to about 0.15% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.05% to about 0.15% with embodiments incrementally in the range at about 0.5% intervals, or with respect to a particular preferred embodiments of the surface treatment composition (3) about 0.1% (plus or minus 0.05%), or 0.100% as shown in Table 7.

Similarly, the amount five-fold orange oil (CAS No: 8028-48-6) available from Florida Chemical Company, 351 Winter Haven Blvd., Winter Haven, Fla. included in the particular embodiment of the inventive surface treatment composition shown in Table 7 can be about 1.8% or as to other embodiments in the range of about 1.0% to about 2.5% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 1.0% to about 2.5% with embodiments incrementally in the range at about 0.5% intervals, or with respect to a particular preferred embodiments of the surface treatment composition (3) about 1.8% (plus or minus 0.50%), or 1.800% as shown in Table 7.

Again dyes such as solvent yellow of about 0.0011% and solvent red of about 0.00004% can be included in particular embodiments of the inventive surface treatment composition, but could also be of greater or lesser weight percent depending upon the particular dyes selected and depending upon the level of sensorial perceivable desired for a particular embodiment of the inventive surface treatment composition (3). A numerous and wide variety of fragrances and dyes are available suitable for use in embodiments of the surface treatment composition (3) and it is not intended that the inventive composition(s) be limited to inclusion of any single particular fragrance or dye or combination of fragrances or dyes in the composition.

TABLE 8

| Raw Material | Wt Precent |
|---|---|
| Calumet LVP 100 | 47.3495 |
| Exxon Isopar M | 47.3495 |
| Solvent 142 | 3.0000 |
| Masil SF-100 Silicone Oil | 2.0000 |
| Macol 5100 | 0.1000 |
| Benzaldehyde | 0.2000 |

The formulation set out by Table 8 provides a particular embodiment of the inventive surface treatment composition (3). The formulation of Table 8 is intended to provide a person of ordinary skill in the art sufficient information to make a wide range of embodiments of the inventive surface treatment composition (3) by adjusting the proportions of the various raw materials listed.

For example, the amount of Calumet LVP 100 (hydrotreated light distillates petroleum, CAS No.: 64742-47-8) available from Calumet Specialty Products, L.P., 270 Waterfront Pkwy. E. Dr., Suite 200, Indianapolis, Ind. included in the particular embodiment of the inventive surface treatment composition of Table 8 can be 47.35% by weight; however, other embodiments can be produced by adjusting the amount of Calpar 100 within the range of about 40% to 60% by weight, or even a greater or lesser weight percent depending on the particular deposition material (6) to be treated and the particular surface (5) to be treated and could as to certain embodiments of the surface treatment composition(s)(3) be by weight percent a percentage selected from the group consisting of: between about 40% to about 42%; between about 41% to about 43%: between about 42% to about 44%; between about 43% to about 45%; between about 44% to about 46%; between about 45% to about 47%; between about 46% to about 48%; between about 47% to about 49%; between about 48% to about 50%; between about 49% to about 51%; between about 50% to about 52%; between about 51% to about 53%; between about 52% to about 54%; between about 53% to about 55%; between about 54% to about 56%; between about 55% to about 57%; between about 56% to about 58%; between about 57% to about 59%; between about 58% to about 60% or with respect to a particular embodiments of the surface treatment composition (3) about 47% (plus or minus 5.0%), or about 47.35% as shown in Table 8

Similarly, the amount Exxon Isopar M (2-Hydroxy-1,2,3-propanetricarboxylic acid, CAS No: 77-92-9) available from ExxonMobil Chemical Company, 13501 Katy Freeway, Houston, Tex. included in the particular embodiment of the inventive surface treatment composition shown in Table 8 can be about 47.4% or as to other embodiments in the range of about 10% to about 20% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 10% to about 13%, between about 12% to about 14%, between about 13% and about 15%, between about 14% and about 16%, between about 15% and about 17%, between about 16% and about 18%, between about 17% and about 19%, between about 18% and about 20%, or with respect to a particular preferred embodiments of the surface treatment composition (3) about 14.3% (plus or minus 5%), or 14.3300% as shown in Table 7.

Similarly, the amount Solvent 142 (C9-C15 cycloalkanes 60-100% C9-C15 alkanes 10-30%, CAS No:64742-47-8) available from Citgo Petroleum Corporation, 1701 Golf Road, Suite 1-1101, Rolling Meadows, Ill. included in the particular embodiment of the inventive surface treatment composition shown in Table 8 can be about 3.0% or as to other embodiments in the range of about 2.0% to about 4.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 2.0% to about 4.0% with embodiments incrementally in the range at about 0.5% intervals, or with respect to a particular preferred embodiments of the surface treatment composition (3) about 3.0% (plus or minus 0.5%), or 3.00% as shown in Table 8.

Similarly, the amount Masil SF-100 (Polydimethylsiloxane, CAS No. 63148-62-9) available from Emerald Performance Materials, 8309 Wilkinson Boulevard, Charlotte, N.C. included in the particular embodiment of the inventive surface treatment composition shown in Table 8 can be about 2.0% or as to other embodiments in the range of about 1.0% to about 3.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 1.0% to about 3.0% with embodiments incrementally in the range at about 0.5% intervals, or with respect to a particular preferred embodiments of the surface treatment composition (3) about 2.0% (plus or minus 0.5%), or 2.00% as shown in Table 8.

Similarly, the amount Macol 5100 (Oxirane, methyl-, polymer with oxirane, monobutyl ether, CAS No. 9038-95-3) available from PVS Chemicals, Inc., 10900 Harper Avenue, Detroit, Mich. 48213 included in the particular embodiment of the inventive surface treatment composition shown in Table 8 can be about 0.1% or as to other embodiments in the range of about 0.05% to about 0.15% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.05% to about 0.15% with embodiments incrementally in the range at about 0.5% intervals, or with respect to a particular preferred embodiments of the surface treatment composition (3) about 0.1% (plus or minus 0.05%), or 0.100% as shown in Table 8.

Similarly, the amount Benzaldehyde (CAS No:100-52-7) available from Sciencelab.com, 14025 Smith Road, Houston, Tex. included in the particular embodiment of the inventive surface treatment composition shown in Table 8 can be about 0.2% or as to other embodiments in the range of about 0.1% to about 0.3% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.05% to about 0.15% with embodiments incrementally in the range at about 0.5% intervals, or with respect to a particular preferred embodiments of the surface treatment composition (3) about 0.2% (plus or minus 0.05%), or 0.200% as shown in Table 8.

Again fragrance(s) and dyes included in particular embodiments of the inventive surface treatment composition can be in the range of between about 0.025% and about 1.0% by weight, but could also be of greater or lesser weight percent depending upon the particular fragrance(s) selected and depending upon the level of sensorial perceivable scent or color desired for a particular embodiment of the inventive surface treatment composition (3). A numerous and wide variety of fragrances and dyes are available suitable for use in embodiments of the surface treatment composition (3) and it is not intended that the inventive composition(s) be limited to inclusion of any single particular fragrance or dye or combination of fragrances or dyes in the composition. The fragrance portion, such as lemon fragrance available for example from Aromatic Fragrances and Flavors International, Marietta, Ga., or other fragrance(s) as desired can then be added to the prior combination and mixed until the solution is homogeneous and clear.

Now referring primarily to Table 9, an exemplary embodiment of the inventive surface treatment composition (3) can include formulations which include the raw materials listed in column one admixed in the exemplary weight percentages indicted in column two (labeled "wt %"). Numerous embodiments of the inventive surface treatment composition can be prepared by altering the weight percentage of the raw materials within the range weight percentage ("Range Wt %") shown in column three with water making up the balance.

TABLE 9

| Raw Materials | Wt % | Range Wt % |
|---|---|---|
| Water | 55.80 | remaining balance |
| Gluconic Acid 50% | 8.00 | 3.0 to 15.0 |
| Phosphoric Acid 75% | 30.00 | 15.0 to 50.0 |
| Dowanol DPNB | 0.95 | 0.1 to 1.0 |
| Glucopon 425 | 5.00 | 1.0 to 10.0 |
| Methyl salicylate | 0.25 | 0.05 to 0.5 |
| Total | 100 | |
| Density | 9.7200 | Lbs/Gallon |

Now referring primarily to Table 9, various embodiments of the inventive surface treatment composition (3) comprising or consisting of the one or more of the raw materials within the range wt % can be made by adjustment of the wt % within the range indicated with the balance of the composition being made up with water. The particular composition comprising or consisting of the amounts of raw materials listed under wt. % is illustrative of the wide variety of surface treatment compositions (3) that can be produced for the purpose of treating surfaces (5).

Additionally, while the treatment composition (3) described in Table 9 includes methyl salicylate as a fragrance particular embodiments of the treatment composition (3) can be prepared without any fragrance or with one or more of a numerous and wide variety of fragrances in various permutations and combinations as persons of ordinary skill in the art would understand.

Additionally, the treatment composition (3) described in Table 9 can further include one or more dyes or colorants as persons of ordinary skill in the art would understand.

Water (CAS NO.: 7732-18-5) can comprise the balance of the surface treatment composition (3) by weight percent, as shown in Table 9. However, it not intended that embodiments of the inventive surface treatment compositions (3) be limited solely to or consisting of the raw materials listed and embodiments of the inventive surface treatment compositions (3), but rather the inventive surface treatment composition(s)(3) can further include or comprise raw materials not listed. Understandably, as additional raw materials are added the balance weight percent water will correspondingly be altered, or the weight percent of each raw material may be altered to accommodate the additional raw materials. The water can be filtered, de-ionized, distilled, or water otherwise filtered or purified.

Gluconic acid, 50% in water (gluconic acid, CAS No: 526-95-4) available from jungbunzlauer.com included in the particular embodiment of the inventive surface treatment composition shown in Table 1 can be about 8.0% or as to other embodiments in the range of about 3.0% to about 15.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 3.0% to about 10.0%, between about 7.5% to about 12.5%, between about 10.0% to about 15.0%, between about 12.5% to about 15.0%, or with respect to a particular preferred embodiments of the surface treatment composition (3) about 8.0% (plus or minus 5.00%), or 8.0% as shown in Table 1.

Phosphoric acid, 75% (phosphoric acid, CAS No.: 7664-38-2, 75% by wt % in water, CAS NO.: 7732-18-5) available from Thermos International BV included in the particular embodiment of the inventive surface treatment composition shown in Table 1 can be about 30.0% or as to other embodiments in the range of about 15.0% to about 50.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 15.0% to about 25.0%, between about 20.0% to about 30.0%, between about 25.0% to about 35.0%, between about 30.0% to about 40.0%, between about 35.0% to about 45.0%, or between about 45.0% to about 50.0% or with respect to a particular preferred embodiments of the surface treatment composition (3) about 30.0% (plus or minus 5.00%), or 30.0% as shown in Table 1.

Dowanol DPnB, (dipropylenglycol-n-butylether, CAS No.: 35884-42-5) available from Dow Chemical Company included in the particular embodiment of the inventive surface treatment composition shown in Table 1 can be about 0.95% or as to other embodiments in the range of about 0.1% to about 1.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 0.05% to about 0.4%, between about 0.2% to about 0.6%, between about 0.4% to about 0.8%, between about 0.6% to about 1.0% or with respect to a particular preferred embodiments of the surface treatment composition (3) about 0.95% (plus or minus 0.5%), or 0.95% as shown in Table 1.

Glucopon 425 N(CAS No.: 197099-29-9)(Alkylpolyglycoside C8-10, CAS No.: 68515-73-1>30-<60 wt. % and Alkylpolyglycoside C10-16 CAS No.: 110615-47-9>10-<30 wt. % in water 48-52 wt. % CAS No.: 7732-18-5) available from BASF included in the particular embodiment of the inventive surface treatment composition shown in Table 1 can be about 5.0% or as to other embodiments in the range of about 1.0% to about 10.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 1.0% to about 3.0%, between about 2.0% to about 4.0%, between about 3.0% to about 5.0%, between about 4.0% to about 6.0%, between about 5.0% to about 7.0%, between about 6.0% to about 8.0%, between about 7.0% to about 9.0%, between about 8.0% to about 10.0%, or with respect to a particular preferred embodiments of the surface treatment composition (3) about 5.0% (plus or minus 2.0%), or 5.0% as shown in Table 1.

Methyl salicylate (CAS No.: 9041-28-5)(oil of wintergreen) available from Arylessence included in the particular embodiment of the inventive surface treatment composition shown in Table 1 can be about 0.25% or as to other embodiments in the range of about 0.05% to about 0.5% by weight, but could also be of greater or lesser weight percent and could as to certain embodiments of the surface treatment composition(s)(3) be by weight percent a percentage selected from the group consisting of: between about 0.0% to about 0.2%, between about 0.1% to about 0.3%, between about 0.2% to about 0.4%, between about 0.3% to about 0.5 or with respect to a particular preferred embodiments of the surface treatment composition (3) about 0.25% (plus or minus 0.1%), or 0.25% as shown in Table 1.

TABLE 10

| Raw Materials | Wt % | Range Wt % |
|---|---|---|
| Water | 55.80 | remaining balance |
| Gluconic Acid 50% | 8.00 | 3.0 to 15.0 |
| Phosphoric Acid 75% | 30.00 | 15.0 to 50.0 |
| Dowanol DPNB | 0.95 | 0.1 to 1.0 |
| Tomadol 91-6 | 5.00 | 1.0 to 10.0 |
| Methyl salicylate | 0.25 | 0.05 to 0.5 |
| Total | 100 | |
| Density | 9.7200 | Lbs/Gallon |

As set forth in Table 10, Tomadol 91-6 (ethoxylated alcohol, CAS No: 68439-46-3), available from Air Products and Chemicals, Inc., 7201 Hamilton Boulevard, Allentown, Pa. can be included in the particular embodiment of the inventive surface treatment composition of about 5.0% or as to other embodiments in the range of about 1.0% to about 10.0% by weight, but could also be of greater or lesser weight percent depending on the particular deposition material (6) to be treated and the particular surface (5) to be treated and could as to certain embodiments of the surface treatment composition(s)(3) be by weight percent a percentage selected from the group consisting of: between about 1.0% to about 3.0%, between about 2.0% to about 4.0%, between about 3.0% to about 5.0%, between about 4.0% to about 6.0%, between about 5.0% to about 7.0%, between about 6.0% to about 8.0%, between about 7.0% to about 9.0%, between about 8.0% to about 10.0%, or with respect to a particular preferred embodiments of the surface treatment composition (3) about 5.0% (plus or minus 2.0%), or 5.0% as shown in Table 10.

As can be easily understood from the foregoing, the basic concepts of the present invention may be embodied in a variety of ways. The invention involves numerous and varied embodiments of a surface treatment compositions and methods for making and using such surface treatment compositions including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "surface treatment" should be understood to encompass disclosure of the act of "treating a surface"—whether explicitly discussed or not—and, conversely, were there effectively disclosure of the act of "treating a surface", such a disclosure should be understood to encompass disclosure of a "surface treatment" and even a "means for treating a surface." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the compositions herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A surface treatment composition, comprising:

an amount of water;

an amount of 2-phosphonobutane-1,2,4 tricarboxylic acid, wherein said amount of 2-phosphonobutane-1,2,4 tricarboxylic acid comprises about 0.05 weight percent and about 0.85 weight percent;

an amount of citric acid, wherein said amount of citric acid comprises about 4.0 weight percent and about 10.0 weight percent;

an amount of L(+)-lactic acid, wherein said amount of L(+)-lactic acid comprises about 0.88 weight percent and about 35.2 weight percent;

an amount of methanesulphonic acid, wherein said amount of methanesulphonic acid comprises about 1.7 weight percent and about 10.0 weight percent;

an amount of glycolic acid, wherein said amount of glycolic acid comprises about 0.7 weight percent and about 31.5 weight percent;

an amount of propylene glycol methyl ether, wherein said amount of propylene glycol methyl ether comprises about 0.1 weight percent and about 1.0 weight percent;

an amount of disodium cocoamphodipropionate, wherein said amount of disodium cocoamphodipropionate comprises about 0.038 weight percent and about 3.8 weight percent; and an amount of ethoxylated alcohol including a mixture of alcohols of nine to eleven carbons containing an average of six equivalents of ethoxylation, wherein said amount of ethoxylated alcohol comprises about 0.1 weight percent and about 10.0 weight percent; and wherein said surface treatment composition includes less than 0.1 weight percent phosphorus.

2. The surface treatment composition of claim 1, further comprising an amount of fragrance.

3. The surface treatment composition of claim 1, wherein said amount of 2-phosphonbutane-1,2,4 tricarboxylic acid comprises about 0.25 weight percent;

said amount of citric acid comprises about 4.0 weight percent;

said amount of L(+)-lactic acid comprises about 7.0 weight percent;

said amount of methanesulphonic acid comprises about 7.0 weight percent;

said amount of glycolic acid comprises about 14.0 weight percent;

said amount of propylene glycol methyl ether comprises about 0.95 weight percent;

said amount of disodium cocoamphodipropionate comprises about 0.2 weight percent; and said amount of ethoxylated alcohol including a mixture of alcohols of nine to eleven carbons containing an average of six equivalents of ethoxylation comprises about 3.0 weight percent.

4. The surface treatment composition of claim 3, further comprising an amount of fragrance.

5. The surface treatment composition of claim 4, wherein said amount of fragrance comprises an amount of an amount of lemon fragrance or an amount of methyl salicylate.

6. The surface treatment composition of claim 4, wherein said amount of fragrance comprises an amount of an amount of lemon fragrance and an amount of methyl salicylate.

7. The surface treatment composition of claim 6, wherein said amount of lemon fragrance comprises about 0.1 weight percent and said amount of methyl salicylate comprises about 0.1 weight percent.

8. A surface treatment composition, comprising:

an amount of water;

an amount of 2-phosphonobutane-1,2,4 tricarboxylic acid of about 0.25 weight percent;

an amount of citric acid of about 4.0 weight percent;

an amount of L(+)-lactic acid of about 7.0 weight percent;

an amount of methanesulphonic acid of about 7.0 weight percent;

an amount of glycolic acid of about 14.0 weight percent;

an amount of propylene glycol methyl ether of about 0.95 weight percent;

an amount of disodium cocoamphodipropionate of about 0.2 weight percent;

an amount of ethoxylated alcohol including a mixture of alcohols of nine to eleven carbons containing an average of six equivalents of ethoxylation of about 3.0 weight percent;

an amount of lemon fragrance of about 0.1 weight percent; and and amount of methyl salicylate of about 0.1 weight percent, wherein said surface treatment composition includes less than 0.1 weight percent phosphorus.

9. A method of treating a surface with a composition, comprising contacting said surface with a composition comprising:

an amount of water;

an amount of 2-phosphonobutane-1,2,4 tricarboxylic acid of about 0.25 weight percent;

an amount of citric acid of about 4.0 weight percent;

an amount of L(+)-lactic acid of about 7.0 weight percent;

an amount of methanesulphonic acid of about 7.0 weight percent;

an amount of glycolic acid of about 14.0 weight percent;

an amount of propylene glycol methyl ether of about 0.95 weight percent;

an amount of disodium cocoamphodipropionate of about 0.2 weight percent; and an amount of ethoxylated alcohol including a mixture of alcohols of nine to eleven carbons containing an average of six equivalents of ethoxylation of about 3.0 weight percent, wherein said surface treatment composition includes less than 0.1 weight percent phosphorus.

10. The method of claim 9, further comprising removing the composition from said surface.

11. The method of claim 9, wherein said composition further comprises an amount of fragrance.

12. The method of claim 11, wherein said amount of fragrance comprises an amount of lemon fragrance of about 0.1 weight percent.

13. The method of claim 12, wherein said amount of fragrance further comprises an amount of methyl salicylate of about 0.1 weight percent.

* * * * *